United States Patent [19]

Ohara

[11] 4,226,588

[45] Oct. 7, 1980

[54] SMELTING FURNACE

[76] Inventor: Tadao Ohara, 1-21, #2 Uematsu-cho, 8-chome, Yao City, Osaka 581, Japan

[21] Appl. No.: 958,905

[22] Filed: Nov. 8, 1978

[30] Foreign Application Priority Data

Jul. 14, 1978 [JP] Japan ..... 53-86566

[51] Int. Cl.[3] ..... F27B 9/16

[52] U.S. Cl. ..... 432/138; 266/163; 266/228; 432/161; 432/210

[58] Field of Search ..... 432/138, 157, 166, 161, 432/210, 239; 414/185, 180, 199; 266/163, 227, 228; 65/136

[56] References Cited

U.S. PATENT DOCUMENTS 2,044,616 6/1936 Kinker ..... 432/138

2,834,157 5/1958 Bowes ..... 432/161

*Primary Examiner*—John J. Camby

*Attorney, Agent, or Firm*—Schwartz, Jeffery, Schwaab, Mack, Blumenthal & Koch

[57] ABSTRACT

A smelting furnace for metal such as aluminum or aluminum-base alloy having a relatively low melting point comprising a rotatable lower furnace body having an upper opening and an upper furnace body secured to a frame and having a lower opening for covering the opening of the lower furnace body. A feed inlet chamber is formed in a peripheral portion of the upper furnace body and positioned above the opening of the lower furnace body. The feed inlet chamber has opposite side walls extending downward to the upper edge of the lower furnace body to separate the feed inlet chamber from the interior chamber of the furnace.

6 Claims, 6 Drawing Figures

SMELTING FURNACE

BACKGROUND OF THE INVENTION

Aluminum alloys are widely used in various industries for rolling, aluminum sashes, regeneration, casting and die casting. Aluminum smelting furnaces usually used are limited solely to the same open hearth type as used for smelting steel materials.

When feeding the material to such furnaces, the lid of the furnace is opened while interrupting heating, permitting heat to dissipate to temporarily cool the furnace. Since the feed of the material and heating are alternately repeated to melt the material, the operation requires a prolonged period of time and necessitates a large-scale device for the disposal of the soot and smoke resulting from charging of the material. Additionally the slag floating on the molten metal during the operation must be removed by a burdonsome procedure with a scraper rod having a length approximately equal to the overall length of the furnace. It is therefore desired to overcome these problems.

SUMMARY OF THE INVENTION

The main object of this invention is to provide a smelting furnace comprising two divided furnace segments of a stationary upper furnace body and a rotatable lower furnace body so that the furnace can be fed while continuously heating the material therein, the furnace thus being adapted for a reduced operation cycle without involving waste of energy and further permitting removal of slag with ease.

DESCRIPTION OF THE PREFERRED EMBODIMENTS

Figure 1:
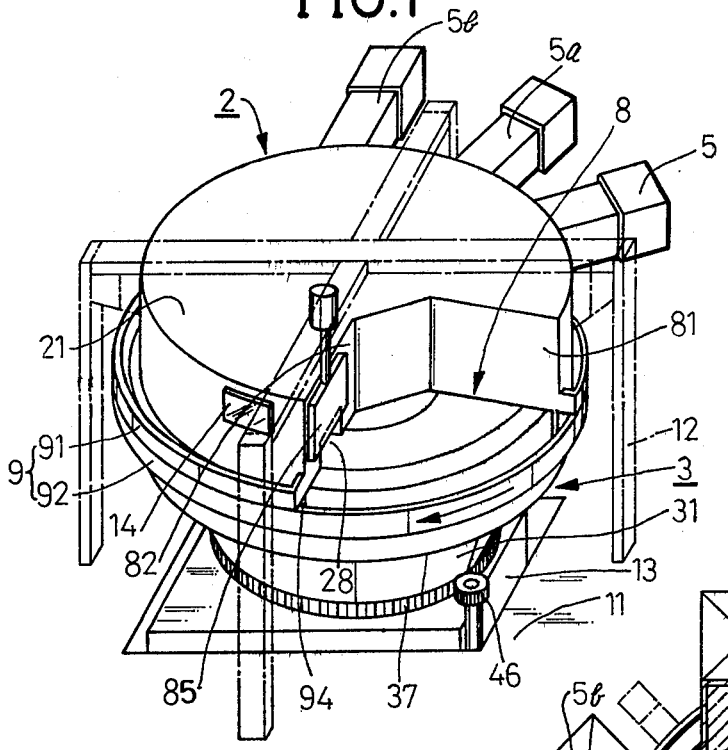
FIG. 1 is a perspective view showing a smelting furnace according to the present invention.
Figure 2:
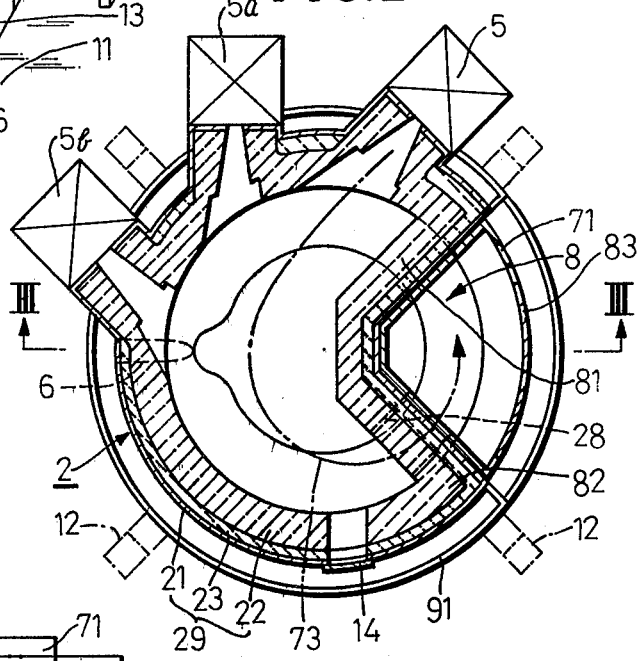
FIG. 2 is a cross sectional view showing an upper furnace body.
Figure 3:
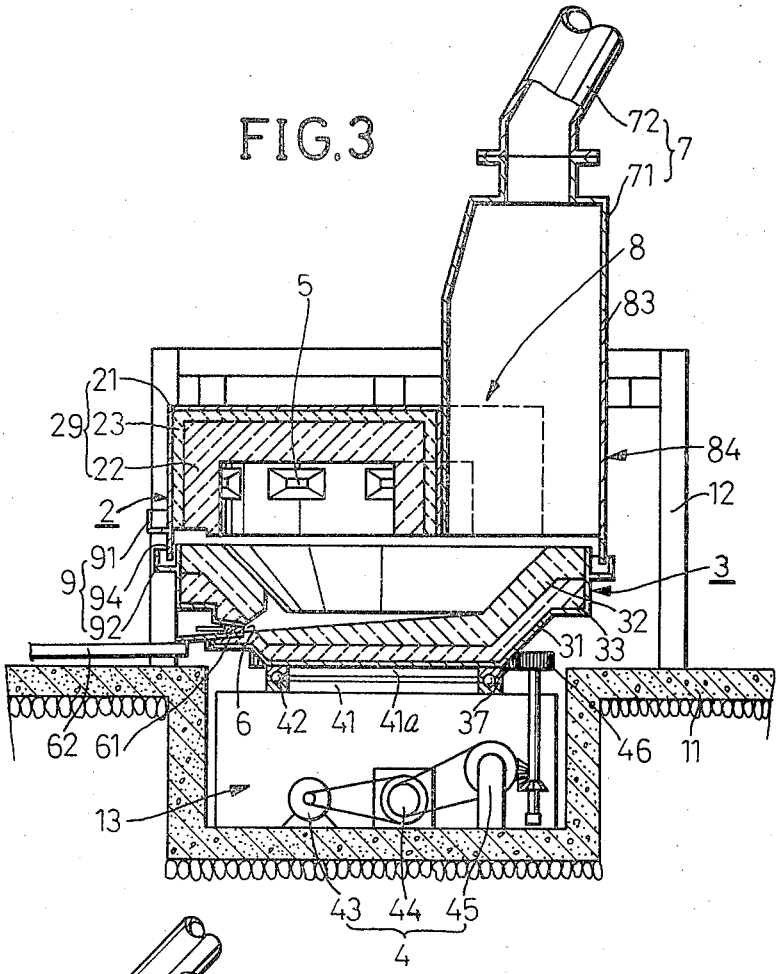
FIG. 3 is a view in section taken along the line III—III in FIG. 2.

With reference to FIGS. 1 to 3, a smelting furnace of this invention comprises a rotatable lower furnace body 3 open at its top, an upper furnace body 2 covering the opening of the lower furnace body 3 and secured to a frame 12 on a floor 11, and means for rotating the lower furnace body 3.

The lower furnace body 3 is provided with a circular rail 41 positioned at an upper portion of a machine chamber 13 formed under the floor surface. Rollers or balls 42 are provided between the rail 41 and another rail 41*a* attached to the lower surface of the lower furnace body 3. Thus the lower furnace body 3 supported at the upper portion of the machine chamber 13 is rotatable in a horizontal plane.

The lower furnace body 3 is in the form of a substantially circular dish which is open at its top and includes an outer wall 31 of the thick steel sheet and a layer 32 of high-quality refractory and another layer 33 of heat-insulating material which line the outer wall 31 to provide a furnace bed. The furnace bed is formed, at a lower portion thereof, with a molten steel outlet 6 extending through the furnace wall. A detachable plug 61 is inserted into the outlet 6 to close the outlet 6 during operation. The furnace bed is gently inclined downward toward the outlet 6, permitting the molten metal within the furnace to spontaneously flow toward the outlet 6 for discharge. The outer end of the outlet 6 is provided with a trough 62 for running off the molten metal.

The lower furnace body 3 has at the lower end of its peripheral wall a gear 37 in the form of a ring and coupled to the rotating means 4 including for example a motor 43, a speed change unit 44, a reduction unit 45 and gear 46. The lower furnace body 3 is driven on the rail 41 by the meshing engagement between the gear 46 and the gear 37.

The upper furnace body 2 secured to and suspended from the frame 12 around the body 2 has an open lower end positioned close to the lower furnace body 3.

Like the lower furnace body 3, the upper furnace body 2 includes an outer wall 21 of thick steel sheet uniformly lined with a layer 22 of high-quality refractory and another layer 23 of heat-insulating material to provide a furnace wall 29. As shown in FIGS. 1 to 3, the periphery of the furnace wall 29 is slightly larger in diameter than the open portion of the lower furnace body 3. The top wall of the furnace body 2 is partly cut out in the form of a sector at an angle of about 90 degrees to provide a feed inlet chamber 8 and expose about one fourth of the opening of the lower furnace body 3. Side walls 81 and 82 defining the feed inlet chamber 8 extend from the cutout portion of the top wall to the level of the upper edge of the lower furnace body 3 at its opening to separate the inlet chamber 8 from the furnace chamber. The feed inlet chamber 8 is provided with exhaust means 7 for discharging exhaust gas as will be described below with reference to FIGS. 3 and 4.

A burner 5 is attached to the peripheral wall of the upper furnace body 2 tangentially of the wall. Auxiliary burners 5*a* and 5*b* are provided suitably in accordance with the capacity of the furnace. An inspection window 14 is formed in the peripheral wall at a position remotest from the burner 5.

Figure 4:
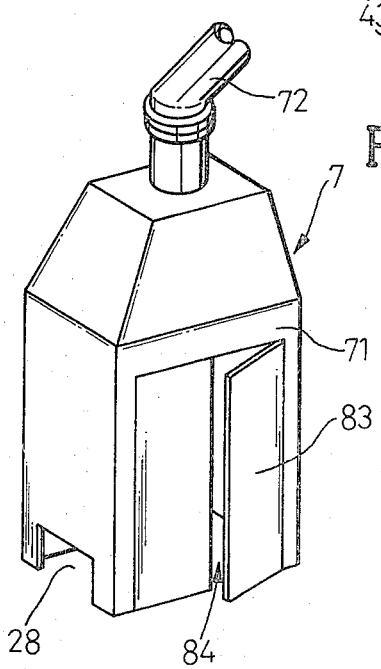
FIG. 4 is a perspective view showing exhaust means.

With reference to FIGS. 3 and 4, the exhaust means 7 comprises a box 71 fitting in the feed inlet chamber 8 and having an open lower end. The box 71 is provided at its top with a hood and an exhaust tube 72 for releasing combustion waste gas from the interior of the furnace to the outside. A door 83 pivoted to the side plate of the box 71 facing outside openably closes a feed inlet 84. In opposed relation to the direction in which the flame forced out from the main burner 5 swirls, exhaust groove 28 is formed in one side wall 82 of the feed inlet chamber 8 and in a side wall of the box 71 at their lower portions respectively as seen in FIGS. 1 and 4 so that the flame from the burner 5 will swirl along the peripheral wall of the upper furnace body 2 and pass through the groove 28 into the exhaust means 7 along a path 73 indicated in the dot-and-dash line in FIG. 2.

Figure 5:
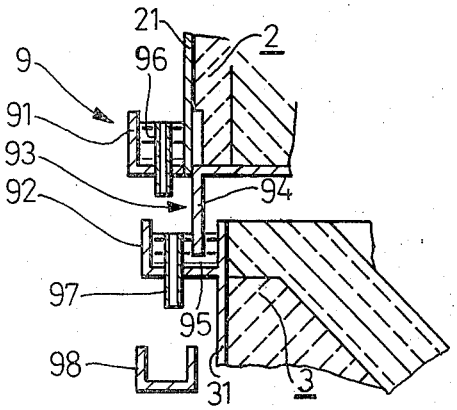
FIG. 5 is a sectional view showing a water seal.

In the vicinity of a junction 93 between the upper furnace body 2 and the lower furnace body 3, there is provided a water seal 9 for confining flames within the furnace and preventing heating of the outer wall steel sheets 21 and 31. As shown in FIG. 5, the water seal 9 is provided by water troughs 91 and 92 attached to the upper furnace body 2 and the lower furnace body 3 close to the junction 93, and a seal wall 94 extending from the lower end of the outer wall 21 of the upper furnace body 2 into the water trough 92 on the lower furnace body 3. The water 95 filling the water trough 92 and the seal wall 94 seal off the interior of the furnace. The water trough 91 on the upper furnace body 2 is filled with water, which flows through an overflow pipe 96 into the lower water trough 92 and further downward through an overflow pipe 97 on the trough 92 into a receiving trough 98 disposed below the through 92. The water is then drawn off from the trough 98.

An unillustrated feeder is disposed close to the feed inlet 84 of the upper furnace body 2. One side wall 82 of the feed inlet chamber 8 positioned toward the direction of rotation of the lower furnace body 3 is provided with a vertically movable scraper 85 for discharging slag as seen in FIG. 1. A slag discharge trough (not shown) is disposed close to the feed inlet 84.

Figure 6:
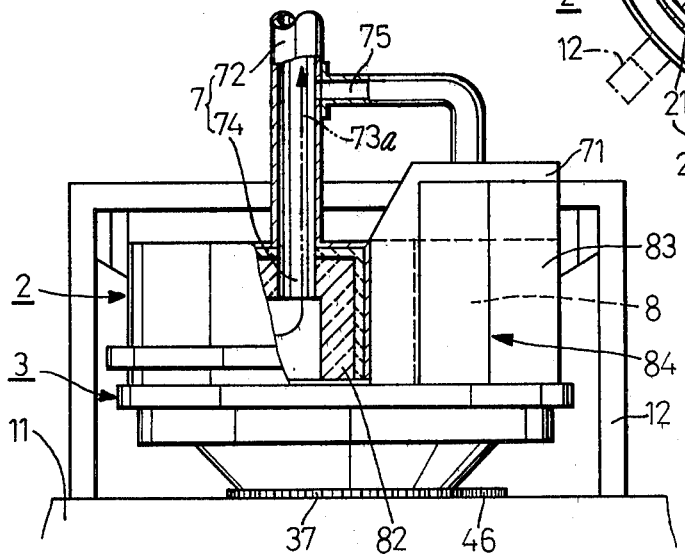
FIG. 6 is a front view partly broken away and showing another smelting furnace embodying the present invention.

FIG. 6 shows another embodiment of this invention in which the exhaust means 7 positioned above the feed inlet chamber 8 in the first embodiment is provided on the top wall of the upper furnace body 2. The exhaust means 7 comprises a vent 74 formed in the top wall and positioned close to the side wall 82 of the inlet chamber 8 and an exhaust tube 72 provided for the vent 74, whereby the high-temperature gas forced out from the burner is caused to swirl along the peripheral wall of the upper furnace body 2 and then flow upward at the end of the path of swirling along the side wall 82 into the exhaust means 7. Thus a path of outflow of the gas, 73*a*, is formed. The hood on the top of the box 71 provided with the feed inlet is held in communication with the exhaust tube 72 by a bypass 75 to provide a channel for discharging the soot and smoke formed on feeding. Since the gas outflow path is separate from the discharge channel from the feed inlet chamber to the exhaust means in this embodiment, the groove 28 for keeping the two paths in communication need not be provided.

OPERATION

At first the lower furnace body 3 is brought into rotation at a predetermined constant speed (for example one revolution per ten minutes for a 3-ton furnace) in a clockwise direction in FIG. 1 before chargeing the material into the furnace body 3. The furnace is preheated with the combustion gas of the burner 5. Subsequently the material is placed into the lower furnace body 3 fully to its upper edge through the inlet 84 by the unillustrated feeder or power shovel. With the rotation of the lower furnace body 3, the material passes under the side wall 82 of the inlet chamber 8 into the furnace chamber in which the material is exposed to the combustion gas of the burner 5 and heated to a molten state. The gas advances along the path 73, passes through the exhaust groove 28 in the side wall 82 and is run off through the exhaust tube 72 on the box 71. When the material within the lower furnace body is melted to a reduced mass, the furnace body 3 is replenished with the material. When the material within the lower furnace 3 has wholly been melted to form a specified amount of molten metal, the melt is subjected to deoxidation and degasification in the usual manner. The oxides floating on the surface of the melt and passing the feed inlet chamber 8 is removed by the scraper 85 lowered along the side wall 82 to the level of the molten metal. The removal of the oxides can be performed automatically or manually with use of a scraper rod. A short scraper rod is fully useful since there is no necessity to use the rod over the entire interior area of the furnace; the slag appearing in the inlet chamber 8 with the rotation of the lower furnace body 3 needs only to be scraped off. The feed inlet chamber 8, which is shielded from the furnace chamber by the side walls 81 and 82, involves reduced radiation of heat, so that the operator, when standing in front of the feed inlet 84, can remove the slag by the scraper rod with greater ease than conventionally.

After the slag has been removed, the lower furnace body 3 is stopped with the molten metal outlet 6 in alignment with the molten metal discharge trough 62, and the plug 61 is removed from the outlet 6, whereby the melt is run off.

On completion of the discharge of the molten metal, the foregoing operation is repeated again. Thus the material can be fed and melted continuously without stopping the burner 5 throughout the entire operation starting with the feeding and ending with the discharge of the molten metal.

With the embodiment shown in FIG. 6, the waste gas advances along the aforementioned outflow path 73*a* after heating the material and is directly run off from the furnace through the vent 74 formed in the top wall of the upper furnace body 2 and through the exhaust tube 72 without flowing into the feed inlet chamber 8. Moreover the soot and smoke which are liable to occur upon feeding are drawn off through the exhaust means 7 by way of the hood on the box 71 and of the bypass 75. As a result, hot gas, soot or smoke will not blow out from the feed inlet 84, thus enabling the operator to feed the furnace or withdraw slag therefrom with improved safety and greater ease.

The scope of this invention is not limited to the foregoing description and to the disclosure of the drawings, and other changes and modifications may be readily made by those skilled in the art without departing from the spirit of the invention. Accordingly such changes and modifications are to be included within the scope of the invention.

I claim:

1. A smelting furnace, comprising:

a lower furnace body for containing molten metal supported rotatably, said lower furnace body being formed generally in the shape of a substantially circular dish having a bottom bed, and having an upper opening, said lower furnace body comprising at a lower portion thereof a normally-closed molten metal outlet and means for selectively opening said outlet, and wherein the bed of said furnace is inclined downwardly toward said molten metal outlet;

means for rotating said lower furnace body;

an upper furnace body covering the top of the lower furnace body to define an interior chamber of said furnace;

a feed inlet chamber provided in a peripheral portion of said upper furnace body and positioned above the upper opening of the lower furnace body, said feed inlet chamber having opposite side walls extending downwardly to the upper edge of the lower furnace body to laterally separate the feed inlet chamber from the interior chamber of the furnace and said feed inlet chamber being enclosed with a box-like cover which is open at the bottom and includes a selectively openable door on its outer peripheral wall for introducing material into the furnace;

a burner mounted on the upper furnace body; and exhaust means attached to the upper furnace body for releasing combustion waste gas.

2. A smelting furnace as defined in claim 1 wherein the exhaust means comprises a hood and an exhaust tube attached to the top of the box-like cover, and one of the side walls of the feed inlet chamber opposed to the direction in which a flame from the burner swirls and a side wall of the box are each formed with an exhaust groove in a lower portion thereof.

3. A smelting furnace as defined in claim 1 wherein the exhaust means includes a vent formed in the top wall of the upper furnace body and positioned close to one of the side walls of the feed chamber opposed to the direction in which a flame from the burner swirls, the vent being provided with an exhaust tube communication with an upper portion of the box-like cover through a bypass.

4. A smelting furnace as defined in claim 1 wherein a plurality of burners are attached to the peripheral wall of the upper furnace body tangentially of the wall.

5. A smelting furnace as defined in claim 1 wherein the junction between the upper furnace body and the lower furnace body is provided with a water seal comprising a water trough attached to the outer periphery of the lower furnace body and a seal wall extending from the lower edge of the upper furnace into the water trough.

6. A smelting furnace as defined in claim 1 wherein a vertically movable scraper is provided on the side wall of the feed inlet chamber.

* * * * *